US006919869B2

(12) United States Patent
Yoshikawa

(10) Patent No.: US 6,919,869 B2
(45) Date of Patent: Jul. 19, 2005

(54) LIQUID CRYSTAL DISPLAY DEVICE AND A DRIVING METHOD EMPLOYING A HORIZONTAL LINE INVERSION METHOD

(75) Inventor: Fumitake Yoshikawa, Tokyo (JP)

(73) Assignee: NEC LCD Technologies, Ltd. (JP)

( * ) Notice: Subject to any disclaimer, the term of this patent is extended or adjusted under 35 U.S.C. 154(b) by 290 days.

(21) Appl. No.: 10/072,688

(22) Filed: Feb. 8, 2002

(65) Prior Publication Data

US 2002/0109656 A1 Aug. 15, 2002

(30) Foreign Application Priority Data

Feb. 9, 2001 (JP) ..... 2001-033249

(51) Int. Cl.[7] ..... G09G 3/36

(52) U.S. Cl. ..... 345/89; 345/96; 345/89; 345/211

(58) Field of Search ..... 345/89, 96, 211

(56) References Cited

U.S. PATENT DOCUMENTS 4,789,223 A * 12/1988 Kasahara et al. ..... 349/43
5,365,284 A * 11/1994 Matsumoto et al. ..... 348/793
5,751,267 A * 5/1998 Sato et al. ..... 345/96
6,075,477 A * 6/2000 Kokubun et al. ..... 341/154

* cited by examiner

*Primary Examiner*—Sumati Lefkowitz
*Assistant Examiner*—Ming-Hun Liu
(74) *Attorney, Agent, or Firm*—Hayes Soloway P.C.

(57) ABSTRACT

A control circuit receives the digital input data of n-bit and controls horizontal drivers so as to provide a liquid crystal panel with voltage corresponding to the input data during a 1H cycle based on standard voltage. In addition, the control circuit creates gradation data by inverting each bit of the input data and controls the horizontal drivers so as to provide the liquid crystal panel with voltage in response to the output gradation data during the subsequent 1H cycle. In this case, gradation-γ correction voltage relation is symmetrical with respect to a point in the center between the top gradation step and the bottom gradation step.

6 Claims, 7 Drawing Sheets

LIQUID CRYSTAL DISPLAY DEVICE AND A DRIVING METHOD EMPLOYING A HORIZONTAL LINE INVERSION METHOD

BACKGROUND OF THE INVENTION

1. Field of the Invention

This invention relates to a liquid crystal display device and its driving method, more specifically, to a liquid crystal display device and its driving method employing the horizontal line inverting method.

2. Description of the Related Art

In general, the AC driving method is employed in liquid crystal display devices. This is because the useful life becomes short if the liquid crystal layer is driven with DC voltage. Also well known as a driving method for reducing flicker during AC driving is the horizontal line inverting method that inverts polarity at every unit horizontal synchronization cycle (1H cycle).

For example, as shown in FIG. 1, a liquid crystal display device using this prior art driving method has a switching circuit 107 that switches the outputs from a first standard voltage generating circuit 106*a* that generates positive-polarity standard voltage and a second standard voltage generating circuit 106*b* that generates negative-polarity standard voltage, in synchronization with the synchronization signal provided by a control circuit 101. The output of the switching circuit 107 is connected in common to a plurality of horizontal drivers 103 connected to the signal lines of a liquid crystal panel 105.

The control circuit 101, responding to the input data for the image displayed on the liquid crystal panel 105, makes the horizontal drivers 103 apply the voltage provided from the first standard voltage generating circuit 106*a* to the liquid crystal panel 105, corresponding to the input gradation data for a unit 1H cycle. During the subsequent 1H cycle, it makes the horizontal drivers 103 apply the voltage provided from the second standard voltage generating circuit 106*b* to the liquid crystal panel 105.

Further, the control circuit 101 makes a common voltage generating circuit 104 apply a common voltage to the liquid crystal panel 105. To the electrode of each pixel in the liquid crystal panel 105, the horizontal driver 103 supplies a signal voltage corresponding to the gradation data when a vertical driver 102 has chosen a scanning line. Meanwhile, the common voltage generating circuit 104 provides the common voltage for the common electrode opposing this pixel electrode. Then an image of gradation corresponding to the voltage gap between the pixel electrode and the common electrode is displayed on the liquid crystal panel 105. This common voltage is inverted at every 1H cycle and supplied to the liquid crystal panel 105 in order to enlarge the effective voltage applied to each pixel of the liquid crystal panel 105. The AC driving of the liquid crystal panel is performed by this line inversion at every 1H cycle.

The gradation-γ correction voltage relation of a liquid crystal display device is shown in FIG. 2A. The dotted line represents the gradation-γ correction voltage relation that does not take into account the applied voltage-transmittance property of the liquid crystal layer, while the solid line represents the gradation-γ correction voltage relation incorporating correction that has taken into account the applied voltage-transmittance property of the liquid crystal layer. Since the applied voltage-transmittance property of the liquid crystal layer is not represented with a straight line or is not linear, driving voltage is applied to the liquid crystal panel based on the gradation-γ correction voltage relation denoted with the solid line in the diagram in order to realize gradation display corresponding to the input data in actual liquid crystal display devices.

If γ-correction voltage is applied to the liquid crystal panel 105 of the prior art liquid crystal display device shown in FIG. 1 based on the gradation-γ correction voltage relation represented by the solid line, the applied voltage will be VF for gradation X1, while VG for gradation X2 during the following 1H cycle. Then the effective voltage applied to the liquid crystal layer of the liquid crystal panel 105 will be |VF−VC| and |VG−VC|, respectively. Note that VC represents the common potential supplied to the common electrode opposing the pixel electrode. As a result, the effective voltage levels(F, G) differ from each other between a 1H cycle and the subsequent 1H cycle, as shown in FIG. 2B. This is the cause of flicker.

Besides, the circuit structure becomes complex in the prior art liquid crystal display device shown in FIG. 1 because the switching circuit 107 selects either standard voltage generating circuit 106*a* or 106*b* each generating positive- or negative-polarity standard voltage so as to supply standard voltage to the horizontal drivers 103. Also because the power source voltage Vcc for the standard voltage generating circuits 106*a*, 106*b* is very high, the switching circuit 107 must withstand high voltage. Then the device cost will be high.

SUMMARY OF THE INVENTION

The object of the present invention is to provide a liquid crystal display device and driving method thereof that can reduce flicker with a relatively simple circuit structure by employing the line inversion driving technique.

A liquid crystal display device according to the present invention includes a liquid crystal panel having a plurality of scanning lines and a plurality of signal lines, a standard voltage generating circuit providing a plurality of standard voltages, a vertical driver that scans the scanning lines of said liquid crystal panel one after another, a horizontal driver that receives the plurality of standard voltages provided from said standard voltage generating circuit and supplies gradation voltage to the signal lines of said liquid crystal panel, and a control circuit that creates gradation data by inverting a polarity of input data for each horizontal synchronization cycle and controls the horizontal drivers so as to apply standard voltage corresponding to said gradation data to the liquid crystal panel. A gradation-γ correction voltage relation used by said control circuit for gradation display is symmetrical with respect to a point in a center between a top gradation step and a bottom gradation step.

In this liquid crystal display device, the gradation-γ correction voltage relation is represented with a straight line and the horizontal driver applies γ correction voltage to the liquid crystal panel in response to the input gradation data to meet such a relation. The gradation-γ correction voltage relation may not be represented with a straight line but, for example, a curved line or a polygonal line.

Such input data is, for example, digital data and the control circuit creates polarity-inverted gradation data by inverting each bit in the digital data.

Besides, if the standard voltage generating circuit has a ladder resistance, the gradation-γ correction voltage relation can be determined by setting the resistance values of the ladder resistance.

A driving method of a liquid crystal display device according to the present invention includes the steps of supplying a plurality of standard voltages to horizontal drivers of a liquid crystal panel and scanning the liquid crystal panel with a vertical driver by inverting a polarity of input data for each line for displaying gradation. Said gradation-γ correction voltage relation used in displaying gradation is symmetrical with respect to a point in a center between a top gradation step and a bottom gradation step.

In this case, the gradation-γ correction voltage relation is represented with a straight line, and the horizontal drivers apply γ correction voltage to the liquid crystal panel in response to the input gradation data to meet the relation.

The gradation-γ correction voltage relation may not be represented with a straight line but, for example, a curved line or a polygonal line.

DETAILED DESCRIPTION OF THE PREFERRED EMBODIMENT

Figure 1:
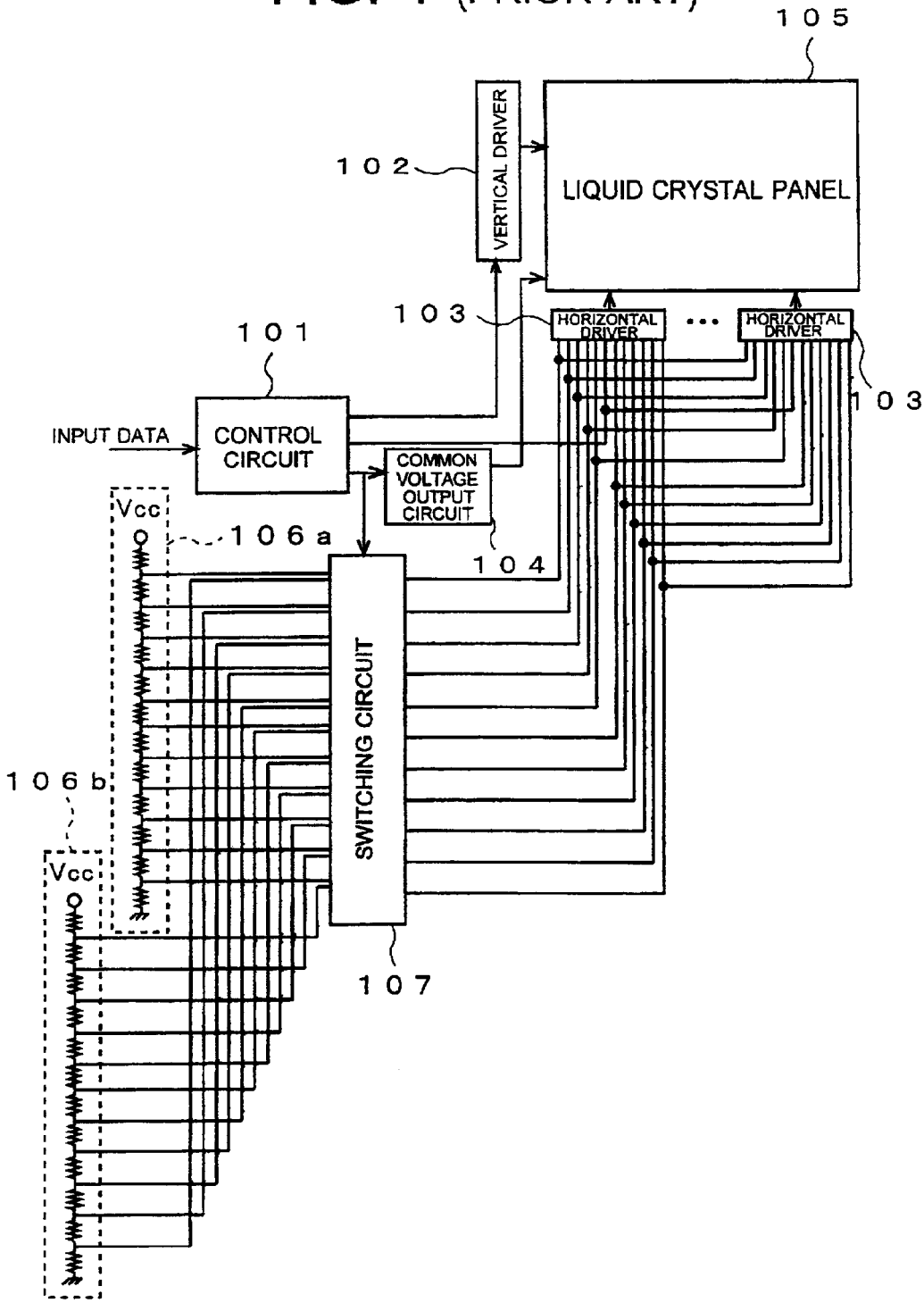
FIG. 1 (PRIOR ART)
FIG. 1 is a block diagram illustrating a prior art liquid crystal display device.
Figure 2A:
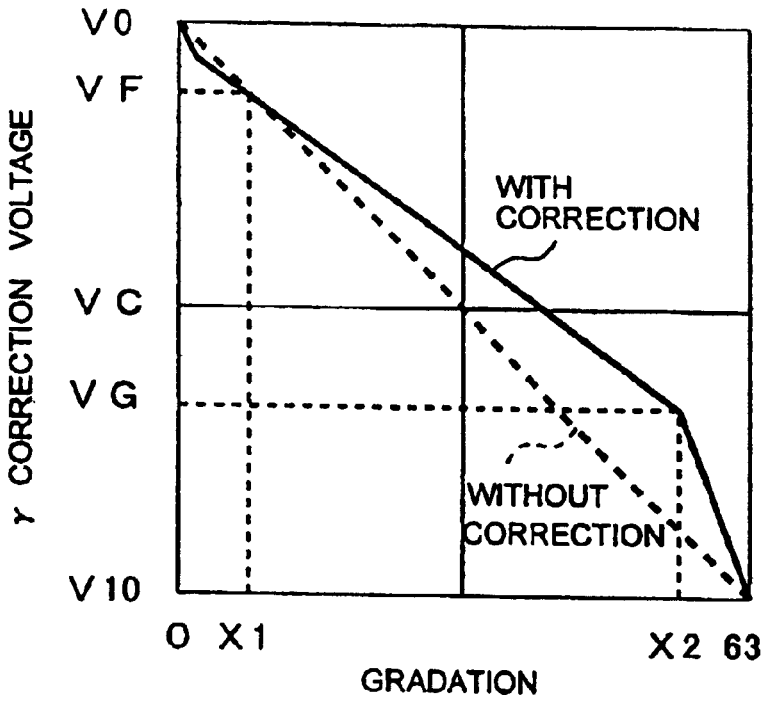
FIG. 2A (PRIOR ART)
FIG. 2A is a graph showing the gradation-γ correction voltage relation used in the driving method for the prior art liquid crystal display device.
Figure 2B:
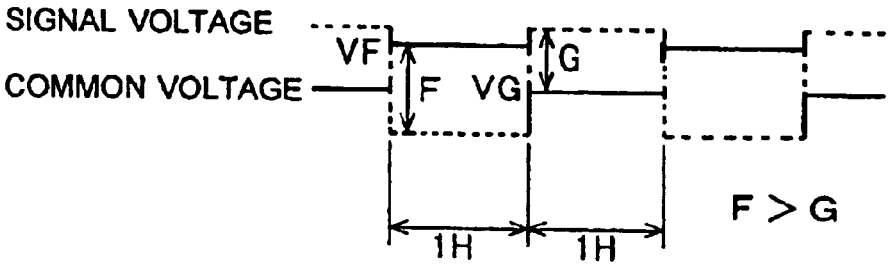
FIG. 2B (PRIOR ART)
FIG. 2B is a waveform diagram showing the signals supplied to the liquid crystal panel based on the prior art driving method.
Figure 3:
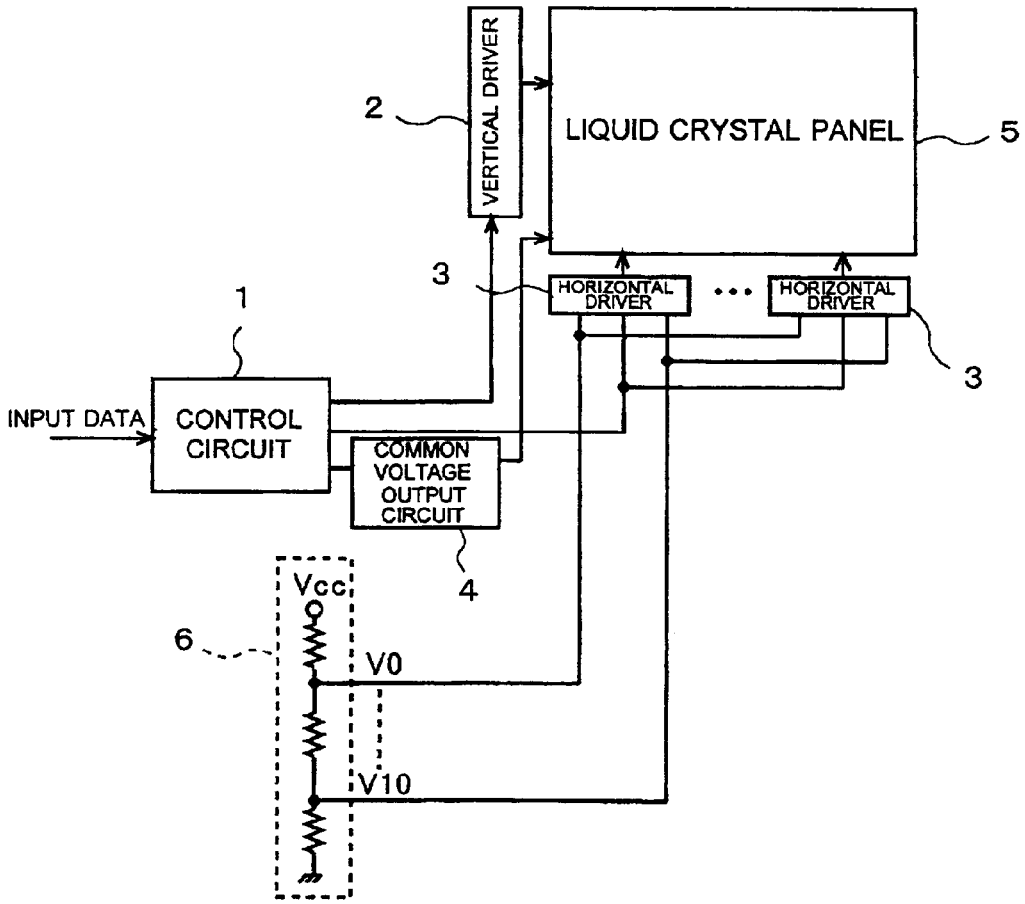
FIG. 3 is a block diagram illustrating the liquid crystal display device according to a first embodiment of the invention.

Now, embodiments of the present invention will be described in detail with reference to the accompanying drawings. FIG. 3 is a block diagram illustrating a liquid crystal display device according to a first embodiment of the present invention. The liquid crystal display device according to the present embodiment has a liquid crystal panel 5, a standard voltage generating circuit 6, a vertical driver 2, a plurality of horizontal drivers 3, and a control circuit 1. The liquid crystal panel 5 is equipped with a plurality of scanning lines and a plurality of signal lines. The standard voltage generating circuit 6 provides a plurality of standard voltages. The vertical driver 2 scans the scanning lines of the liquid crystal panel 5 one after another. The plurality of horizontal drivers 3 supply gradation voltage to the signal lines of the liquid crystal panel 5 receiving the plurality of standard voltages from the standard voltage generating circuit 6. The control circuit 1 creates gradation data by inverting the polarity of the input data for each unit horizontal synchronization cycle and then controls the horizontal drivers 3 so as to provide the liquid crystal panel 5 with standard voltage corresponding to gradation data.

The standard voltage generating circuit 6 has a ladder resistance connected in between the power source voltage Vcc and the standard voltage and supplies 11-levels of standard voltage V0–V10 to the plurality of horizontal drivers 3.

The control circuit 1 receives the digital input data of n-bit and controls the horizontal driver 3 so that it supplies voltage corresponding to this input data to the liquid crystal panel 5 based on the above standard voltage during one horizontal synchronization cycle (1H cycle). Further, the control circuit 1 creates polarity-inverted gradation data by inverting polarity of each bit of the input data and, during the subsequent 1H cycle, makes the horizontal drivers 3 provide the signal lines of the liquid crystal panel 5 with voltage corresponding to the created gradation data based on the above standard voltage. For example, in the case of 64-step gradation, if the gradation X1 for a 1H cycle is three (3), 60 is obtained as the gradation X2 for the subsequent 1H cycle by inverting each bit of this 6-bit X1 (3). If the gradation X2 for a 1H cycle is 60, the gradation X2 for the subsequent 1H cycle becomes three (3) when each bit of this 6-bit data X2 (60) is inverted.

In addition, the control circuit 1 outputs signals of which levels are inverted for each 1H horizontal synchronize cycle. A common voltage output circuit 4 amplifies the level-inverted signals and provides them as the common voltage for the common electrode opposing the pixel electrode of the liquid crystal panel 5. If this common voltage is level-inverted as well, the effective voltage applied to the liquid crystal layer of the liquid crystal panel 5 can be raised.

Figure 4A:
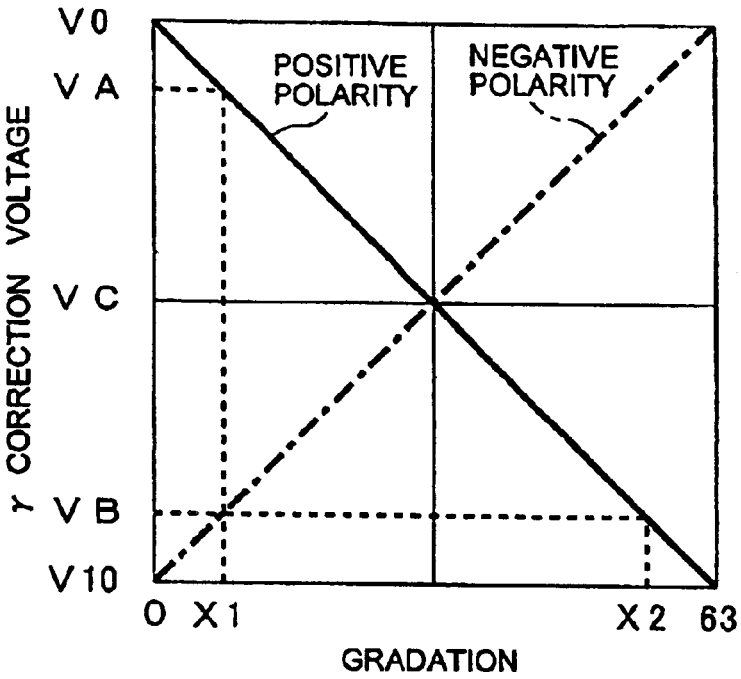
FIGS. 4A, 4C and 4D are graphs showing the gradation-γ correction voltage relation used in the driving method for the liquid crystal display device according to the first embodiment of the invention.
Figure 4B:
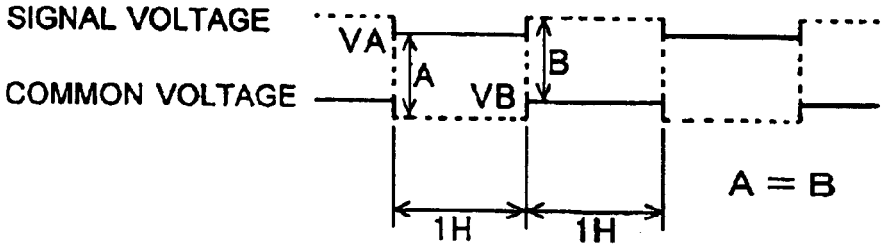
FIG. 4B is a waveform diagram showing the signals supplied to the liquid crystal panel based on this driving method.

FIG. 4A is a graph demonstrating the gradation-γ correction voltage relation used in driving the liquid crystal display device according to the first embodiment of the invention; and FIG. 4B is a waveform diagram showing the signals supplied to the liquid crystal panel during the operation based on the above driving method.

The solid line in FIG. 4A shows the positive-polarity gradation-γ correction voltage relation, while the dot-dash line shows the negative-polarity gradation-γ correction voltage relation. In the present embodiment of the invention, the gradation-γ correction voltage relation for gradation display is symmetric with respect to a point in the center between the top gradation step and the bottom gradation step and can be represented with a straight line. To meet such relation between gradation and voltage, in response to the input gradation data, the horizontal drivers 3 apply γ correction voltage to the signal lines of the liquid crystal panel 5. In the case of a 64-step gradation, the top gradation step is 63, while the bottom one is zero.

The positive-polarity gradation-γ correction voltage relation is referred to when generating γ correction voltage to be applied during a 1H cycle for the input gradation data, while the negative-polarity gradation-γ correction voltage relation is referred to when generating γ correction voltage to be applied during the subsequent 1H cycle. For example, the applied voltage for displaying gradation X1 will be VA with reference to the positive-polarity gradation-γ correction voltage relation for a 1H cycle, while that for the subsequent 1H cycle will be VB with reference to the negative-polarity gradation-γ correction voltage relation. In this case, with VC being the central voltage of the level-inverted common voltage provided from the common voltage output circuit 4, the effective voltages applied to the liquid crystal layer of the liquid crystal panel 5 will be |VA−VC|, |VB−VC|, respectively for the 1H cycle and the subsequent 1H cycle. Since the gradation-γ correction voltage relation is symmetrical with respect to a point, these absolute voltage differences(A, B) become equal to each other(A=B), as illustrated in FIG. 4B.

Note that, as described above in the liquid crystal display device according to the present embodiment, polarity-inverted gradation data is created by inverting each bit of the input data when the digital input signal of n-bit has been received. Then the voltage corresponding to the gradation data is supplied to the signal lines of the liquid crystal panel 5 based on the above standard voltage for the subsequent 1H cycle. As a result, it becomes possible to simplify the circuit structure, eliminating the necessity for preparing a separate standard voltage generating circuit for providing the negative-polarity gradation-γ correction voltage relation.

As described above according to the liquid crystal display device of the present invention, the structure of the standard voltage generating circuit 6 that generates standard voltage can be simplified because the gradation display is performed with reference to the gradation-γ correction voltage relation which is symmetrical with respect to a point in the center between the top gradation step and the bottom gradation step and because the control circuit 1 creates gradation data by inverting polarity of the input data for each one horizontal synchronize cycle and then applies the standard voltage corresponding to the gradation data to the liquid crystal panel 5. Moreover, the useful life of the liquid crystal panel 5 can be extended and its reliability can be augmented because the absolute voltage difference between the voltages applied to the pixel electrode and the common electrode does not change between a 1H cycle and the subsequent 1H cycle. Then flickers can be reduced because the absolute voltage difference is kept constant.

Furthermore, in the driving method for the liquid crystal display device according to the present embodiment, the gradation-γ correction voltage relation is symmetrical with respect to a point in the center between the top gradation step and the bottom gradation step and the gradation-γ correction voltage relation can be represented with a straight line. The horizontal drivers 3 apply γ correction voltage to the signal lines of the liquid crystal panel 5 in response to the input gradation data so as to meet the gradation-γ correction voltage relation. Then the absolute voltage differences applied to the pixel electrode and the common electrode become equal (A=B) during both a 1H cycle and the subsequent 1H cycle. Thereby the useful life of the liquid crystal panel 5 can be extended and its reliability can be augmented. Besides, flickers can be reduced because the absolute voltage difference is kept constant.

Now a second embodiment of the present invention will be described below. This second embodiment has a feature that the gradation-γ correction voltage relation takes into account the applied voltage-transmittance property of the liquid crystal layer. Since its circuit configuration is almost the same as that for the first embodiment shown in FIG. 3, its detail description will not be referred to here.

Figure 5A:
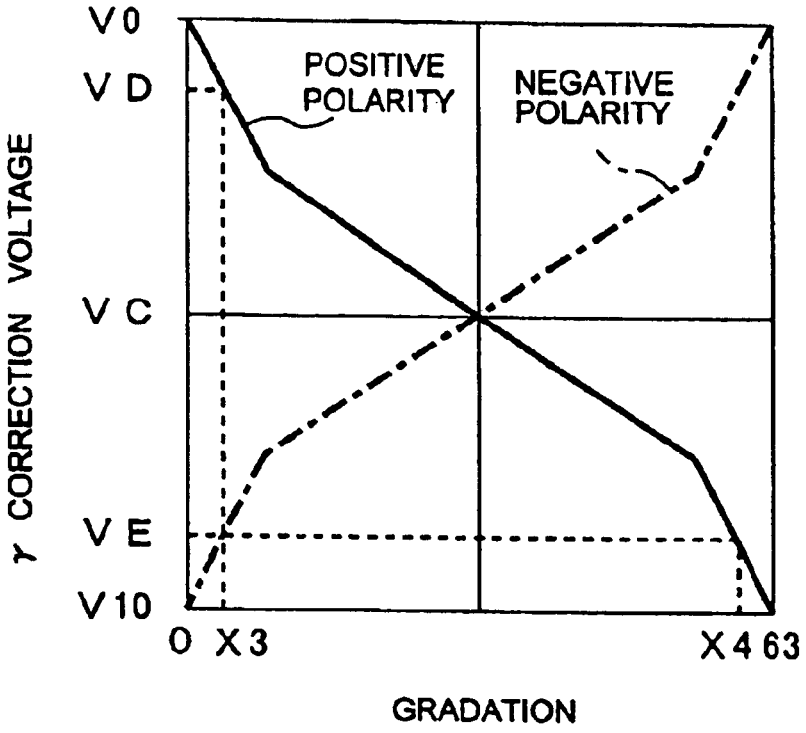
FIGS. 5A, 5C and 5D are graphs showing the gradation-γ correction voltage relation used in the driving method for the liquid crystal display device according to the second embodiment of the invention.
Figure 5B:
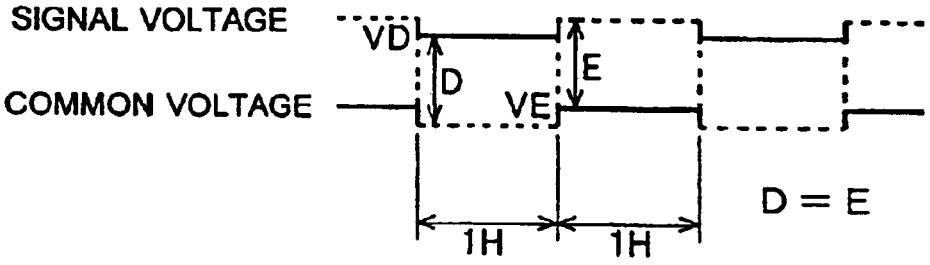
FIG. 5B is a waveform diagram showing the signals supplied to the liquid crystal panel based on this driving method.
Figure 5C:
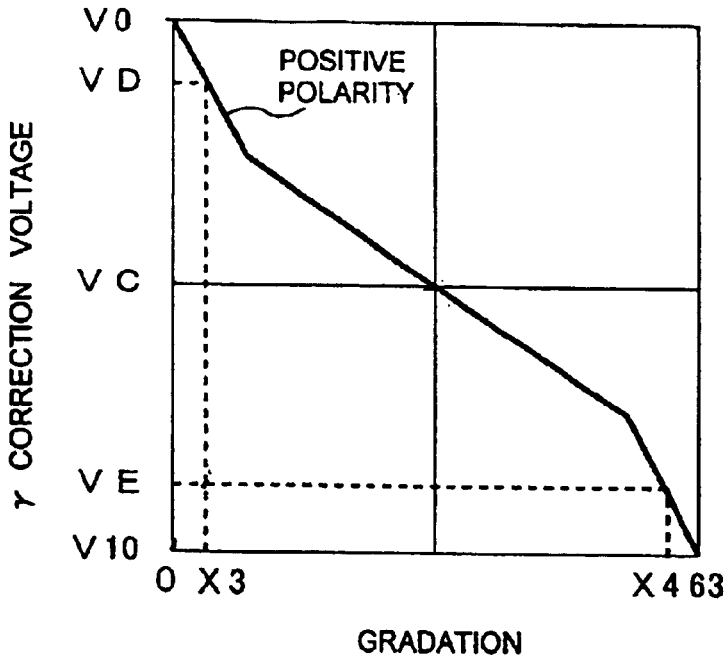
Figure 5D:
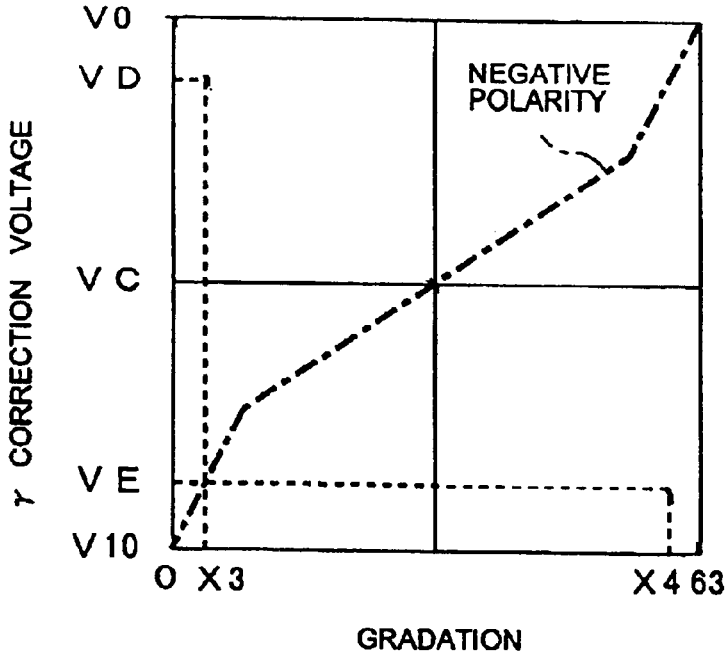

FIGS. 5A, 5C and 5D are graphs demonstrating the gradation-γ correction voltage relations used in the driving method of the liquid crystal display device according to the present invention; and FIG. 5B is a waveform diagram showing the signals supplied to the liquid crystal panel during the operation based on this driving method. As shown in FIG. 5A in the present embodiment, the gradation-γ correction voltage relation is symmetrical with respect to a point in the center between the top gradation step and the bottom gradation step, but not represented with a straight line (in this embodiment, represented with a polygonal line). The horizontal drivers 3 apply γ correction voltage to the liquid crystal panel 5 in response to the input gradation data to meet the relation. This relation can be provided by changing the resistance of each ladder resistance constituting the standard voltage generating circuit 6 of the liquid crystal display device shown in FIG. 3.

Figure 4C:
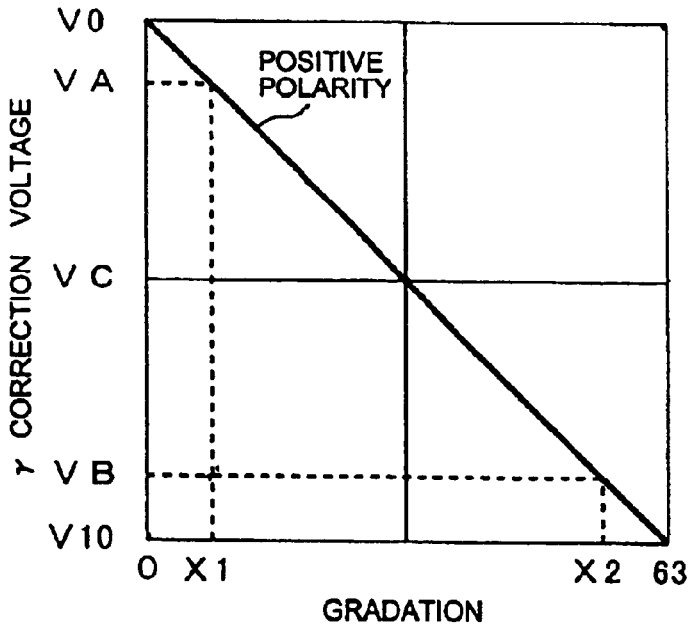
Figure 4D:
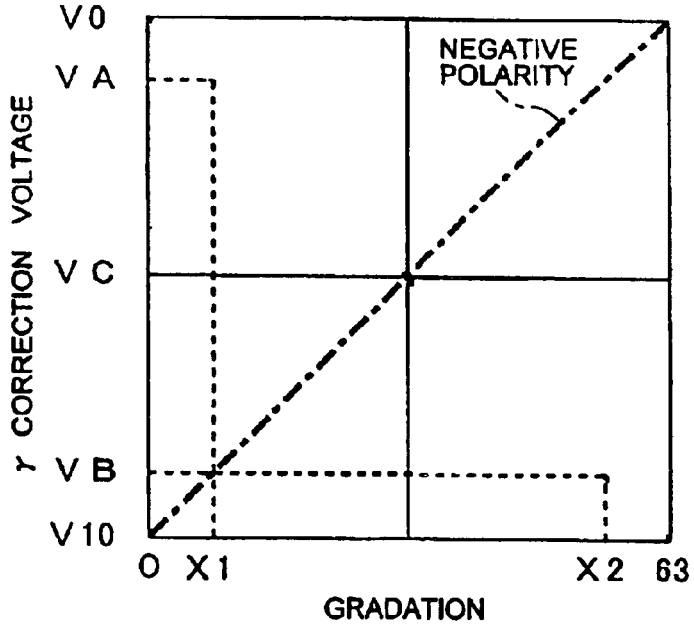

In the same manner as the first embodiment shown in FIGS. 4A, 4C and 4D, the positive-polarity gradation-γ correction voltage relation shown with the solid line in FIG. 5A is referred to when generating γ correction voltage to be applied during a 1H cycle for the input gradation data, while the negative-polarity gradation-γ correction voltage relation shown with the dot-dash line is referred to when generating γ correction voltage to be applied during the subsequent 1H cycle. For example, the applied voltage for displaying gradation X3 will be VD with reference to the positive-polarity gradation-γ correction voltage relation for a 1H cycle, while that for the subsequent 1H cycle will be VE with reference to the negative-polarity gradation-γ correction voltage relation. In this case, the effective voltages applied to the liquid crystal layer of the liquid crystal panel 5 will be |VD−VC|, |VE−VC|, respectively for the 1H cycle and the subsequent 1H cycle. Since the gradation-γ correction voltage relation is symmetrical with respect to a line, these voltage differences in absolute values (D, E) become equal to each other (D=E), as illustrated in FIG. 5B.

This embodiment provides an advantage, in addition to the result attained in the first embodiment, that the line inversion driving taking into account the applied voltage-transmittance property of the liquid crystal layer can be realized and then natural gradation can be realized on the liquid crystal display device. Besides, this advantage can be provided only by changing the individual values of the ladder resistances of the standard voltage generating circuit 6, with no need to add a separate circuit. Thus the increase in cost due to changes in circuit design is minimal.

The present invention has been described in details with respect to various embodiments, and it will now be apparent from the foregoing to those skilled in the art that changes and modifications may be made without departing from the invention in its broader aspects, and it is the invention, therefore, in the appended claims to cover all such changes and modifications as fall within the true spirit of the invention. For example, the gradation-γ correction voltage relation for use in displaying gradation is not limited those described in FIGS. 4A, 4C and 4D and FIGS. 5A, 5C and 5D but may be those represented with other curved lines and polygonal lines, instead of a straight line, as far as it is symmetrical with respect to a point in the center between the top gradation step and the bottom gradation step.

As described above, the liquid crystal display device according to this invention makes it possible to simplify and downsize the circuit configuration of the standard voltage generating circuit. Since the switch that switches the high voltage provided from the standard voltage generating circuit has been eliminated, the circuit configuration can be simplified and reduced in size. The power consumption can also be saved because there is no switch that works at high voltage. Besides, in the control circuit, the line inversion is performed at every 1H cycle based on the gradation-γ correction voltage relation that is symmetrical with respect to a line in the center between the top gradation step and the bottom gradation step. As a result, the effective voltage applied to the liquid crystal layer is kept constant when polarity is inverted. Thus flickers are reduced.

Furthermore, in the driving method for the liquid crystal display device according to the present invention, the line inversion is performed at every 1H cycle based on the gradation-γ correction voltage relation which is symmetrical with respect to a line in the center between the top gradation step and the bottom gradation step. As a result, the effective voltage applied to the liquid crystal layer is kept constant when polarity is inverted. Thus flickers are reduced.

What is claimed is:

1. A liquid crystal display device comprising:

a liquid crystal panel having a plurality of scanning lines and a plurality of signal lines;

a standard voltage generating circuit providing a plurality of standard voltages;

a vertical driver that scans the scanning lines of said liquid crystal panel one after another;

a horizontal driver that receives the plurality of standard voltages provided from said standard voltage generating circuit and supplies said standard voltages to said liquid crystal panel according to gradation data to the signal lines of said liquid crystal panel; and a control circuit that creates said gradation data by inverting a polarity of input data for each horizontal synchronization cycle and controls the horizontal drivers so as to apply standard voltage corresponding to said gradation data to the liquid crystal panel;

wherein a gradation-γ correction voltage relation used by said control circuit for gradation display is symmetrical with respect to a point in a center between a top gradation step and a bottom gradation step.

2. The liquid crystal display device according to claim 1, wherein said gradation-γ correction voltage relation is represented with a straight line and said horizontal drivers apply γ correction voltage to said liquid crystal panel in response to the input gradation data to meet the relation.

3. The liquid crystal display device according to claim 1, wherein said gradation-γ correction voltage relation is represented with a non-straight line and said horizontal drivers apply γ correction voltage to said liquid crystal panel in response to the input gradation data to meet the relation.

4. The liquid crystal display device according to claim 3, wherein said non-straight line is a curved line or a polygonal line.

5. The liquid crystal display device according to claim 1, wherein said input data is digital data and said control circuit creates polarity-inverted gradation data by inverting each bit in said digital data.

6. The liquid crystal display device according to claim 1, wherein said standard voltage generating circuit has a ladder resistance and said gradation-γ correction voltage relation is determined by setting the resistance values of said ladder resistance.

* * * * *